United States Patent [19]

Rhoades

[11] Patent Number: 4,494,397

[45] Date of Patent: Jan. 22, 1985

[54] PORTABLE SHEET BENDING BRAKE

[75] Inventor: James J. Rhoades, Garden City, Mich.

[73] Assignee: Tapco Products Company, Inc., Detroit, Mich.

[21] Appl. No.: 423,459

[22] Filed: Sep. 24, 1982

Related U.S. Application Data

[63] Continuation-in-part of Ser. No. 359,566, Mar. 18, 1982.

[51] Int. Cl.[3] ..... B21D 5/04

[52] U.S. Cl. ..... 72/320; 72/319; 74/571 R

[58] Field of Search ..... 72/319-323, 72/316, 293; 269/236, 239, 277, 284, 285; 74/571 R, 571 L, 571 M, 567

[56] References Cited

U.S. PATENT DOCUMENTS

| | | | |
|---|---|---|---|
| 2,217,378 | 10/1940 | Nilsby | 72/319 |
| 2,271,041 | 1/1942 | Stuckert | 269/236 |
| 2,322,291 | 6/1943 | Gearing | 269/285 |
| 2,387,102 | 10/1945 | Wallis | 269/285 |
| 2,602,358 | 7/1952 | Lile | 269/236 |
| 2,788,687 | 4/1957 | Ridge | 269/239 |
| 2,925,109 | 2/1960 | Walker | 269/285 |
| 3,008,347 | 11/1961 | Perkins, Jr. et al. | 74/571 |
| 3,129,938 | 4/1964 | Riley | 269/236 |
| 3,161,223 | 12/1964 | Marsh | 72/297 |
| 3,402,621 | 9/1968 | Johnson et al. | 74/571 |
| 3,482,427 | 12/1969 | Barnack | 72/319 |
| 3,559,444 | 2/1971 | Blazey et al. | 72/296 |
| 3,817,075 | 6/1974 | Marsh et al. | 72/319 |
| 4,081,986 | 4/1878 | Break | 72/320 |
| 4,092,841 | 6/1978 | Chamber, Jr. | 72/320 |
| 4,237,716 | 12/1980 | Onisko | 72/319 |
| 4,240,279 | 12/1980 | Rhoades | 72/319 |
| 4,364,254 | 12/1982 | Chubb et al. | 72/319 |

FOREIGN PATENT DOCUMENTS

| | | | |
|---|---|---|---|
| 598412 | 12/1925 | France | 74/567 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a plurality of C-shaped frame members that support a first member. The first member has a clamping surface. A second member is hinged to the first member and has a bending surface. A plurality of bars are pivoted to the frame members and support an anvil member that extends longitudinally of the first member. A cam support shaft is rotatably mounted on the frame members and a plurality of eccentric cams are secured on the shaft. Each bar is generally C-shaped and a cam is positioned between the upper and lower flanges thereof. A handle is secured to the shaft such that when the handle is operated, the eccentric cams are rotated to move the bars and, in turn, the anvil member into and out of clamping position. The shaft and eccentric cams are provided with circumferentially spaced teeth extending axially so that the cams are locked in any adjusted position. The position of a cam can be adjusted by moving the cam axially relative to the shaft to disengage the teeth on the cam from the teeth on the shaft, rotating the cam to the desired adjusted position and moving the cam axially to reengage the teeth.

6 Claims, 5 Drawing Figures

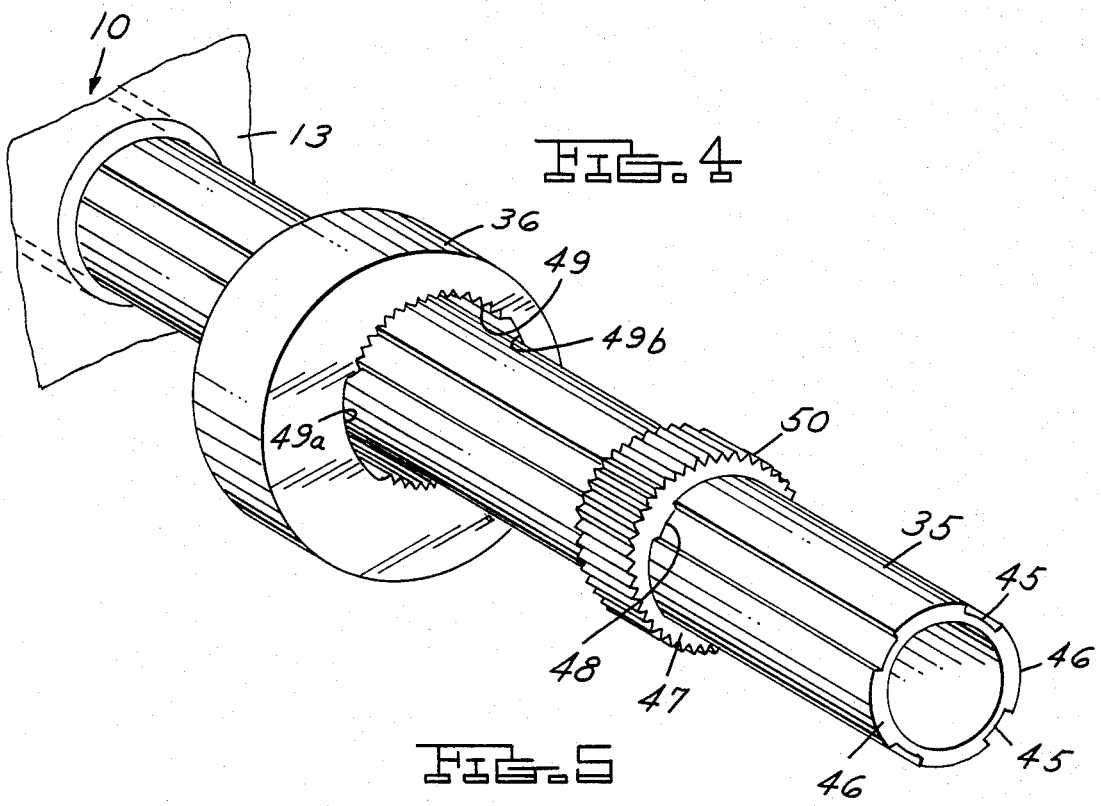
FIG. 4
FIG. 5
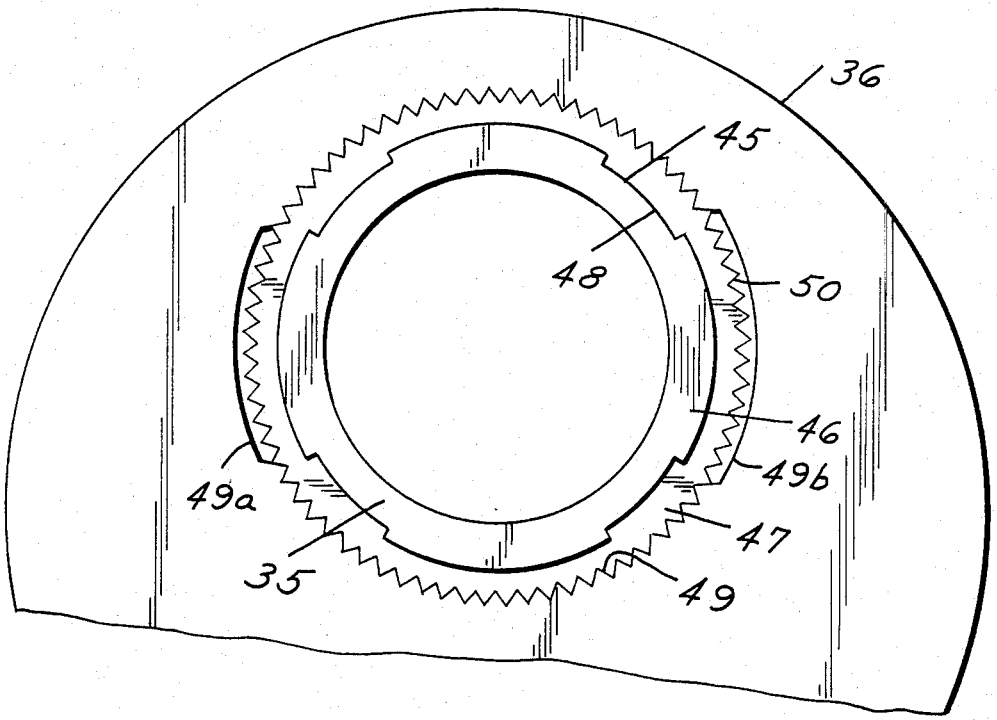

PORTABLE SHEET BENDING BRAKE

This application is a continuation-in-part of U.S. application Ser. No. 359,566 filed Mar. 18, 1982.

This invention relates to sheet bending brakes and particularly to portable sheet bending brakes.

BACKGROUND AND SUMMARY OF THE INVENTION

In the handling of sheet material such as is used for building construction, it has been common in recent times to provide a portable sheet bending brake wherein sheet material is clamped between an anvil member and a clamping surface and a bending member is hinged for bending the sheet material about the anvil member. Typical sheet bending brakes are disclosed in U.S. Pat. Nos. 3,161,223, 3,481,174, 3,482,427, 3,559,444, 3,817,075 and 4,240,279.

As shown, for example, in the aforementioned U.S. Pat. Nos. 3,161,223, 3,559,444, 3,817,075 and 4,240,279, the anvil member is clamped into position by means of a backing plate that has inclined cams underlying a portion of the fixed frame so that when the plate is moved longitudinally by a hand lever, the cams are moved into and out of position clamping and unclamping the backing plate.

In the aforementioned U.S. Pat. Nos. 3,481,174 and 3,482,427, the anvil is supported by pivoted bars that, in turn, are connected by links to a handle that is pivoted on the frame of the brake so that rotation of the handle moves the bars and, in turn, the anvil into and out of clamping position.

It has also heretofore been suggested that eccentric cams be utilized for moving the anvil member into and out of position as shown, for example, in U.S. Pat. Nos. 3,383,899, 4,092,841 and 4,081,986.

One of the problems with prior sheet bending brakes utilizing eccentric cams is that of adjusting the cams on the shaft. Thus, it is common to provide some type of clamp for holding the cams in position. Any such arrangement results in difficulty in adjustment and also the tendency of the clamp arrangement to loosen resulting in a loss of adjustment.

In one arrangement, the cams are adjustably mounted by bolts which can be loosened to permit rotation of the cams about the shaft. Such an arrangement operates satisfactorily but is subject to loss of adjustment in use necessitating frequent adjustment.

Accordingly, among the objectives of the present invention are to provide a portable sheet bending brake incorporating a construction wherein the eccentric cam positions can be readily adjusted and will remain adjusted; which is low in cost; and which can be adjusted without the use of heavy tools.

In accordance with the invention, the shaft and eccentric cams are provided with circumferentially spaced teeth extending axially so that the cams are locked in any adjusted position. The position of a cam can be adjusted by moving the cam axially relative to the shaft to disengage the teeth on the cam from the teeth on the shaft, rotating the cam to the desired adjusted position and moving the cam axially to reengage the teeth.

DESCRIPTION OF THE DRAWINGS

FIG. 4 is a perspective view of a portion of the sheet bending brake during adjustment.

FIG. 5 is an enlarged view of a portion of the brake.

DESCRIPTION

Figure 1:
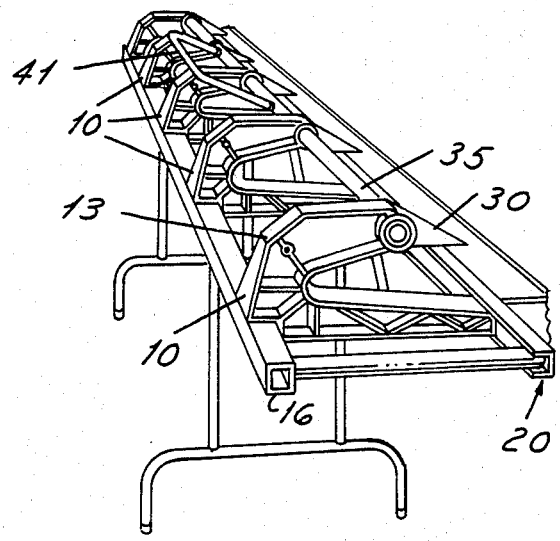
FIG. 1 is a fragmentary perspective view of a sheet bending brake embodying the invention.
Figure 2:
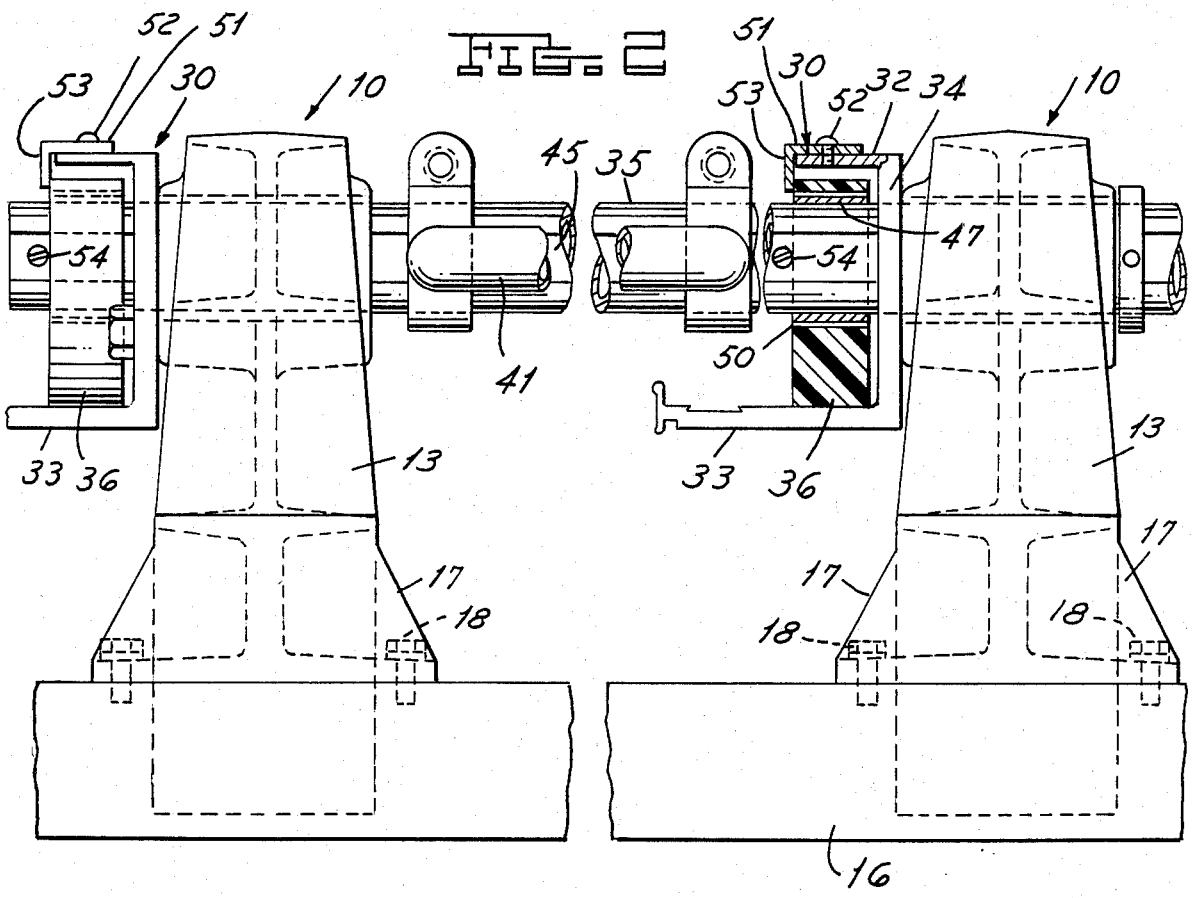
FIG. 2 is a fragmentary part sectional rear elevational view.
Figure 3:
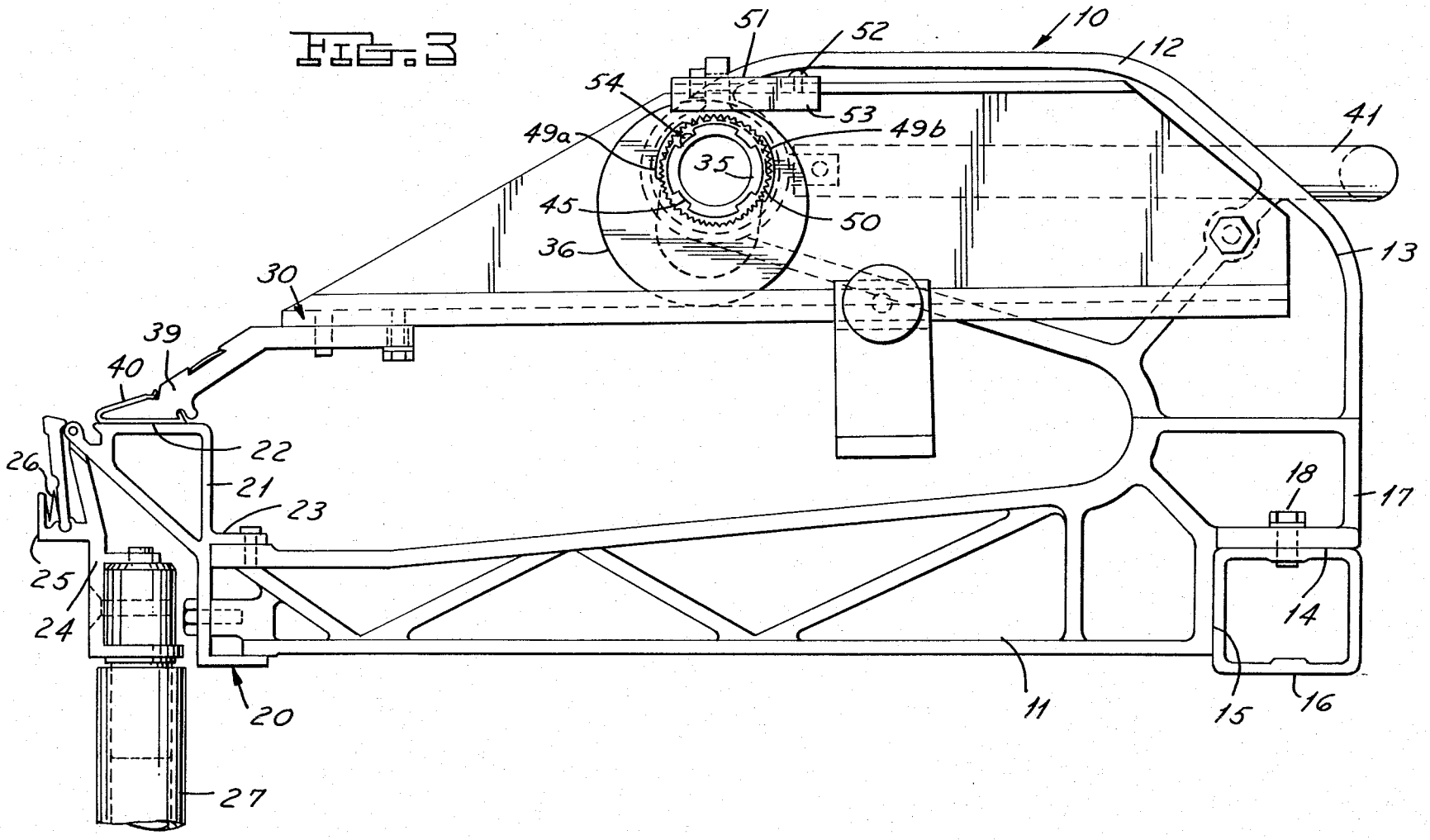
FIG. 3 is a fragmentary sectional view taken along the line 3—3 in FIG. 2.

Referring to FIGS. 1, 2 and 3, the sheet bending brake embodying the invention comprises a plurality of longitudinally spaced C-shaped frame members 10 which are preferably injection molded of reinforced plastic such as 30% glass filled nylon. Each frame member 10 includes a lower arm 11 and an upper arm 12 with a connecting portion 13, the upper arm 12 being shorter than the lower arm 11. Each frame member 10 includes a rearwardly extending recess or notch defined by a horizontal surface 14 and a vertical surface 15 for receiving an extruded aluminum square rear rail 16. As shown in FIG. 2, portion 13 includes laterally extending flanges 17 overlying the upper surface of the rear rail 16 through which screws 18 extend to fasten the rear rail to the frame members.

A first fixed extruded aluminum member 20 is provided on the front end of the lower arms 11 as presently described and comprises an upper generally triangular portion 21 defining a horizontal clamping surface 22 and a lower C-shaped portion 23 that has upper and lower walls that telescope over the free ends of the lower arms 11. Screws fasten the fixed member 20 on the arms 11.

An extruded aluminum bending member 24 is hinged to a portion of the fixed member 20 by a hinge defined by intermeshing projections on the members 24, 20, respectively. A hinge pin extends through aligned openings in the projections to complete the hinge. The bending member 24 further includes a laterally extending L-shaped portion 25 that receives the lower end of an extruded floating member 26 yieldingly urged by a spring 26 against the hinge. The member 26 engages the sheet to be bent and minimizes marring during the bending as more fully described in U.S. Pat. Nos. 3,481,174 and 3,482,427 which are incorporated herein by reference. The bending member 24 further includes a C-shaped portion that supports an adapter 36 for receiving a tubular handle 27.

The sheet bending brake further includes a plurality of extruded aluminum bars 30, a bar 30 being pivoted to each frame member 10 by a bolt 31 at the area of juncture of the rear of the arm 12 and the upper part of the connecting portion 13. Each bar 30 includes an upper flange 32, a lower flange 33, and a vertical wall 34. An extruded aluminum shaft 35 is journalled in the forward ends of the upper arms 12 by plastic bearings and extend through enlarged openings in the vertical walls of the bars 30. A plurality of plastic eccentric cams 36 are fixed on shaft 44 so that they are positioned between the upper and lower flanges 32, 33 of each bar. Each frame member 10 has axially extending bosses surrounding the opening through which shaft 35 extends. A collar 37 holds shaft 35 axially against a boss.

The bars 30 support an anvil member 39 that includes an upper horizontal portion bolted to the lower flange 33 of the bars, and inclined portion and a V-shaped nose portion having a horizontal bottom surface and an inclined upper surface. As shown in FIG. 3, a protective strip 40 of sheet metal such as rolled stainless steel is provided.

A handle 41 is provided for rotating the shaft 44 to rotate cams 45 to move anvil member 60 into and out of clamping relation to surface 22. The handle 41 comprises a U-shaped tube.

The sheet bending brake heretofore described is substantially like that described in the aforementioned U.S. application Ser. No. 359,566 filed Mar. 18, 1982, which is incorporated herein by reference.

In accordance with the invention, the shaft and eccentric cams are provided with circumferentially spaced teeth extending axially so that the cams are locked in any adjusted position. The position of a cam can be adjusted by moving the cam axially relative to the shaft to disengage the teeth on the cam from the teeth on the shaft, rotating the cam to the desired adjusted position and moving the cam axially to reengage the teeth.

More specifically shaft 35 is formed with axially extending grooves 45 defining teeth 46 and a collar 47 having complementary teeth 48 is provided on the shaft 35 with the teeth 48 engaging the teeth 46. Each cam 36 has an eccentric opening formed with a plurality of V-shaped teeth 49 which engage complementary V-shaped teeth 50 on collar 47.

In order to adjust the cam positions on shaft 35, each cam 36 is moved axially relative to the shaft 35 to disengage the teeth 49, 50, is thereafter rotated to the desired adjusted position and moved axially to reengage the teeth 49, 50. The number of teeth 49, 50 is such that small accurate adjustments can be made. For example, the size of the teeth can be such as to provide 5° increments of adjustment. The lower flange 33 of each bar 30 is made sufficiently wide to permit the cam 36 to be disengaged. A retainer 51 is removably fastened to the upper flange 32 by a screw 52 and has a downwardly extending lip 53 which retains the cam 36 against axial movement during normal operation. During adjustment, the retainer is removed and a screw 54 holds the collar 47 against axial movement when the cam 36 is moved axially to disengage the teeth.

The number of teeth can vary but, as shown in the drawings comprises two opposed arcuate segments separated by arcuate areas 49*a*, 49*b* without teeth which have an arcuate extent of approximately thirty degrees.

It can thus be seen that there has been provided a sheet bending brake wherein the positions of the eccentric cams can be readily adjusted and will remain adjusted, which is low in cost, and which can be adjusted without the use of heavy tools.

I claim:

1. A sheet bending brake comprising a plurality of generally C-shaped frame members, each said frame member including a long arm and a short arm spaced from the long arm, spaced rails connecting said frame members, a first member mounted on said long arms defining a clamping surface extending longitudinally, a second bending member, means hinging the bending member to said first member, a bar individual to each said frame member and having its rear end pivoted to said frame member, a clamping member extending longitudinally of said sheet bending brake and fixed to said bars, each said bar being generally C-shaped and including spaced upper and lower flanges and a wall connecting said flanges, a shaft journalled in the forward ends of the short arms of the C-shaped members and extending through openings in the walls of said bars, said shaft having longitudinally extending circumferentially spaced grooves extending throughout the effective length of said shaft, a plurality of collars at longitudinally spaced points on said shaft having radial teeth complementary to said grooves, a cam individual to each said collar on said shaft and individual to each said bar and positioned to cooperate with the lower flanges such that rotation of said shaft pivots said bars and, in turn, said clamping member into and out of clamping position, each said collar and its respective cam having a plurality of circumferentially spaced axially extending teeth whereby the cams are held in circumferentially adjusted position such that the position of a cam can be adjusted circumferentially by moving the cam axially relative to the teeth on the collar to disengage the teeth, rotating the cam to the desired adjusted position and moving the cam axially to re-engage the teeth on the cam with the teeth on the collar.

2. The sheet bending brake set forth in claim 1 wherein one flange of each said bar has a width sufficient to accommodate the axial movement of said cam to disengage said teeth.

3. The sheet bending brake set forth in claim 2 including a retainer member for limiting axial movement of said cam during normal operation.

4. The sheet bending brake set forth in claim 1 wherein said teeth on each said cam comprise circumferentially spaced arcuate segments separated by arcuate areas without teeth.

5. The sheet bending brake set forth in claim 1 wherein said shaft comprises an extruded tubular shaft.

6. The sheet bending brake set forth in claim 5 wherein said cam is made of plastic material.

* * * * *